US005739447A

United States Patent [19]

Hoshino

[11] Patent Number: 5,739,447

[45] Date of Patent: Apr. 14, 1998

[54] ATTACHMENT AND DETACHMENT OF A WEIGHT TO A BOOM CYMBAL STAND

[75] Inventor: Yoshihiro Hoshino, Nagoya, Japan

[73] Assignee: Hoshino Gakki Kabushiki Kaisha, Japan

[21] Appl. No.: 775,943

[22] Filed: Jan. 3, 1997

[30] Foreign Application Priority Data

May 22, 1996 [JP] Japan ..... 8-005472

[51] Int. Cl.[6] ..... G10D 13/08

[52] U.S. Cl. ..... 84/402; 84/422.3; 84/403; 84/421; 248/123.2

[58] Field of Search ..... 84/402, 403, 422.3, 84/421; 248/123.2

[56] References Cited

U.S. PATENT DOCUMENTS 4,987,817 1/1991 Diaz ..... 84/421
5,449,138 9/1995 Ciancio ..... 248/123.2

*Primary Examiner*—Michael L. Gellner
*Assistant Examiner*—Shih-yung Hsieh
*Attorney, Agent, or Firm*—Ostrolenk, Faber, Gerb & Soffen, LLP

[57] ABSTRACT

An attachment and detachment mechanism for a weight held on the boom rod of a boom cymbal stand. The weight has a hole in one side over which a cover is installed and there is an aligned hole in the cover. A spring operated boom rod installation and detaching lever which is disposed between the cover and the side of the weight, has a window through it so that the boom rod can be installed through the cover, the window and into the hole in the weight. The periphery of the window is engagable in a groove in the boom rod under the bias of a spring which moves the lever to cause such engagement. Moving the lever counter to the spring force releases the boom rod so that it can be withdrawn from the hole in the weight and permits insertion of the boom rod in the hole.

10 Claims, 5 Drawing Sheets

ATTACHMENT AND DETACHMENT OF A WEIGHT TO A BOOM CYMBAL STAND

BACKGROUND OF THE INVENTION

The invention relates to attachment and detachment of a weight to cymbal stand and particularly to a boom rod of a boom cymbal stand.

Ordinarily, a boom cymbal stand comprises a boom rod having a cymbal holder at one end and a stand that supports the boom rod. The boom rod is linked to the upper part of the stand at a desired location along the boom rod. It is possible to extend the boom rod like an arm for arranging the cymbal in the drum set, thereby making it possible to use the cymbal in a drum set with a large number of drums.

The boom cymbal stand has an advantage of being convenient to carry around as it can be folded and compactly accommodated. Depending upon the weight of the cymbal, the length of the boom rod and the installation location of the stand, however, it may become difficult to balance the stand as a whole, creating a stability problem. As a result, the boom rod cannot be made very long, thereby making it difficult to give a strong impact to the outside appearance of the drum set.

In order to increase the stability of a boom cymbal stand, it is known to provide a weight at the end of the boom rod opposite the end with the cymbal holder to balance the weights of the cymbal and the rod. That weight is integrally secured to the end of the boom rod with a screw or by pressing the tip of the rod into a hole in the weight. Since the weight and the boom rod cannot be easily disconnected, the boom rod with the weight attached make it often difficult to fold the stand compactly and with a resultant increase in weight.

SUMMARY OF THE INVENTION

It is an object of the present invention to solve the foregoing problem. The invention concerns a mechanism for attaching and detaching the weight of a boom cymbal stand easily to the boom rod and for easily detaching the weight from the boom rod.

The mechanism comprises a boom rod which has a cymbal holder at one end and an installation part, with an annular groove around it, at the other end. A weight has an insertion hole into which the installation part of the boom rod is inserted. A cover is provided over the opening of the insertion hole of the weight. The cover has a hole through which the installation part of the boom rod is inserted into the weight.

A rod installation and detaching lever is held movable and particularly freely slidingly between the weight and the cover. The lever has a change-over plate including a window through which the installation part of the boom rod is inserted. The lever also includes an engagement part which engages the installation part at the end of the boom rod, and particularly engages into the annular groove of the installation part which locks the weight in position along the rod. The engagement part of the lever is at and defined by one side of the window in the lever.

The lever also has a holder which is formed integrally with the change-over plate and is generally on the opposite side of the rod from the engagement part. A spring between the holder of the lever and the weight applies a force to the change-over plate in the normal condition to cause the engagement part to engage the annular groove in the installation part of the boom rod. Releasing that engagement against the bias of the spring frees the installation part of the boom rod to move through the interior of the window of the lever enabling insertion and removal of the installation part into the hole in the weight.

Other objects and features of the invention are explained below with reference to the drawings.

DETAILED DESCRIPTION OF EMBODIMENTS OF THE INVENTION

Figure 1:
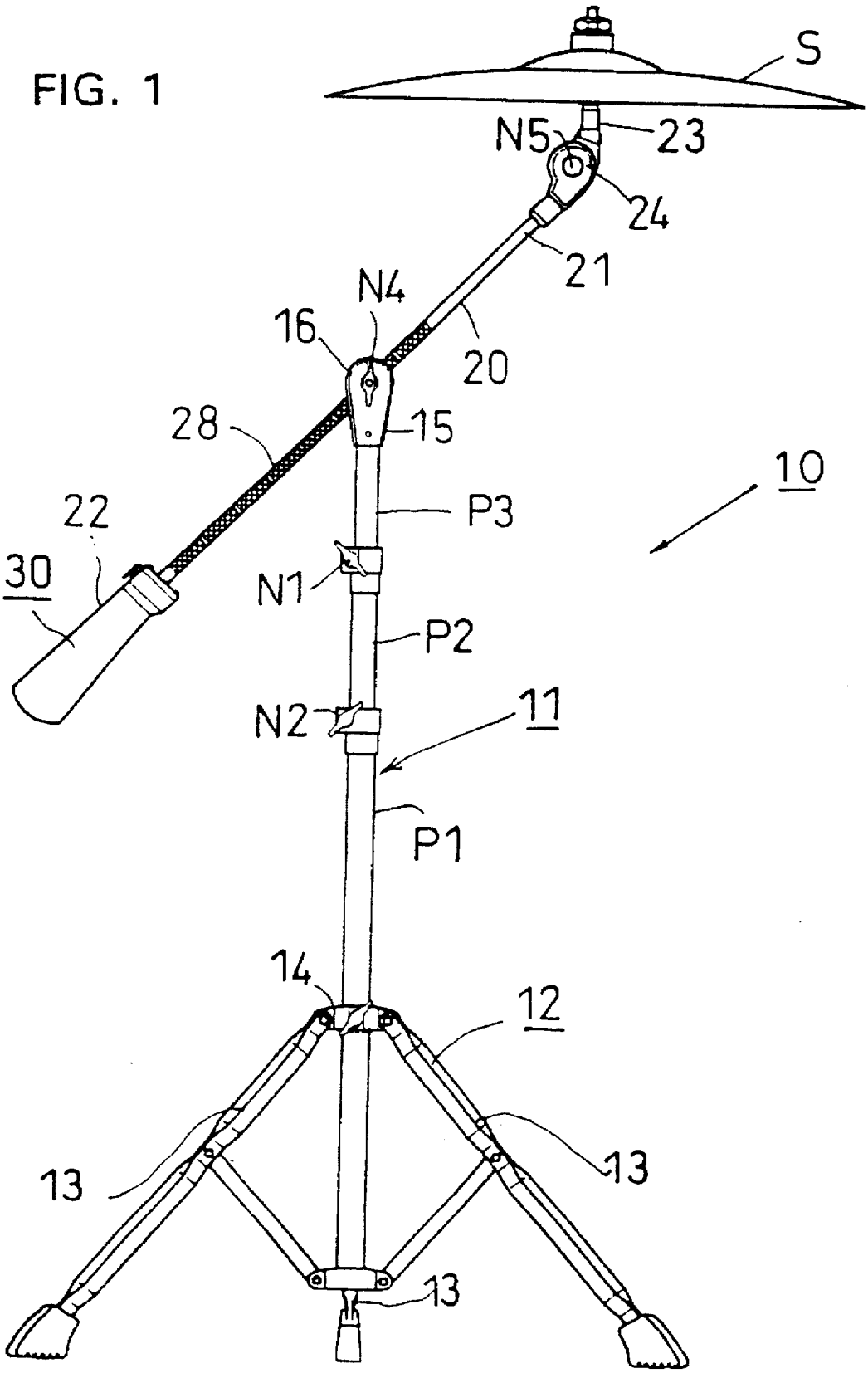
FIG. 1 is a front view of a boom cymbal stand provided with the invention.
Figure 3:
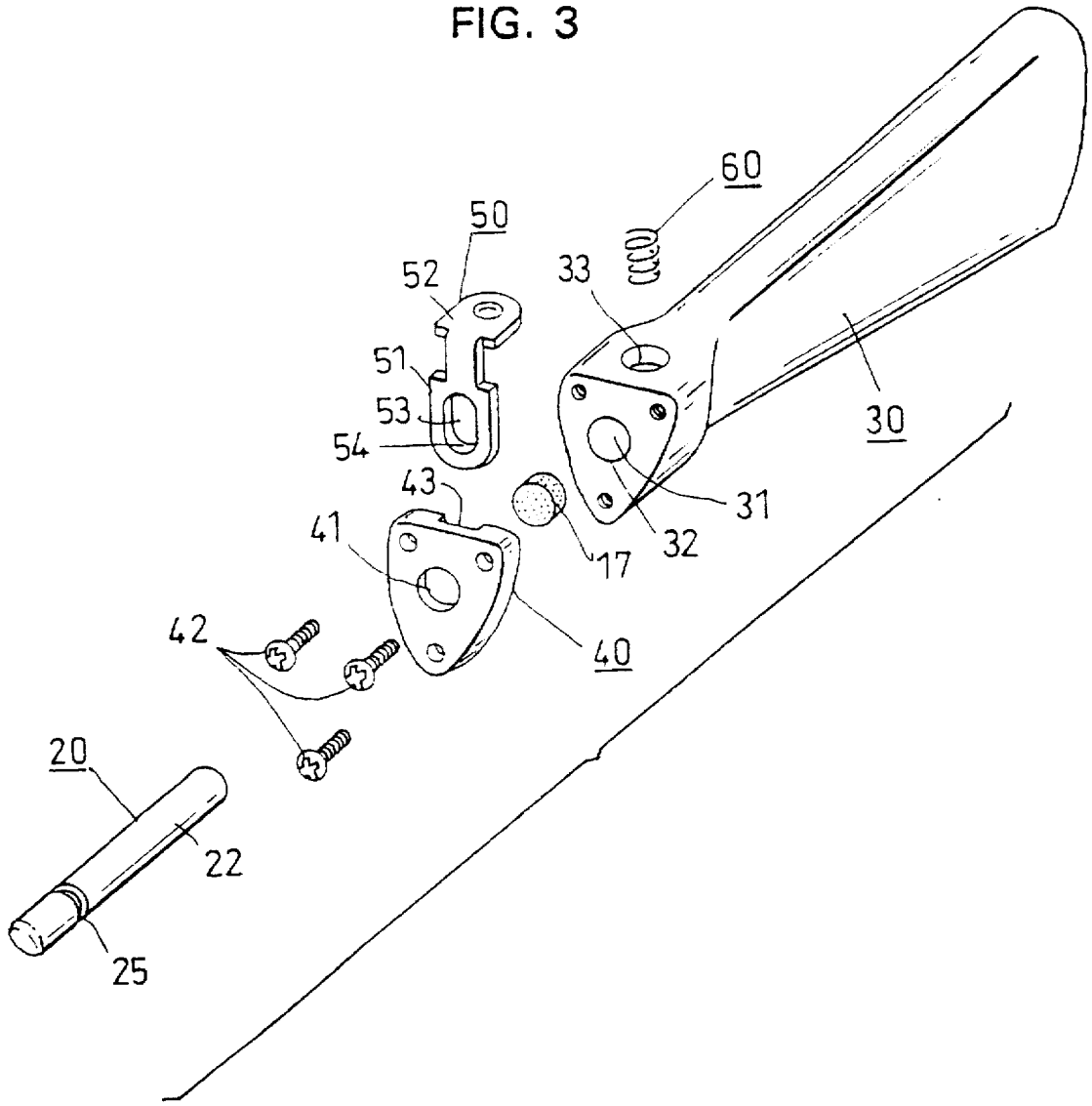
FIG. 3 is an exploded oblique view of the stand showing its essential part.
Figure 4:
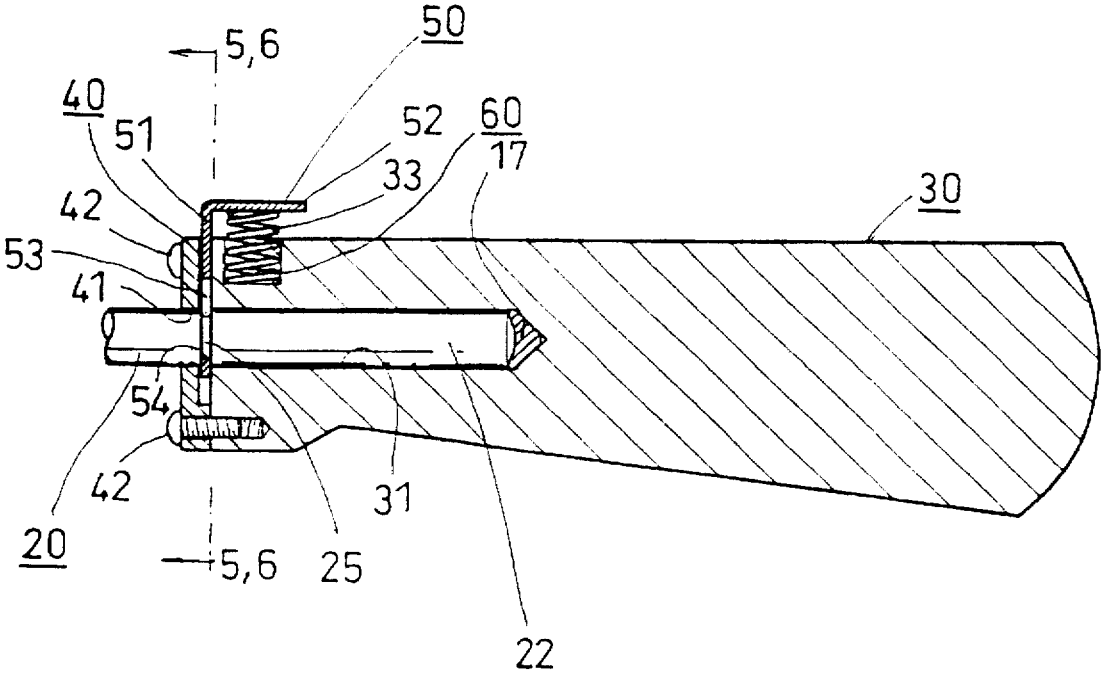
FIG. 4 is a cross section of the essential part of a boom rod with a weight.
Figure 5:
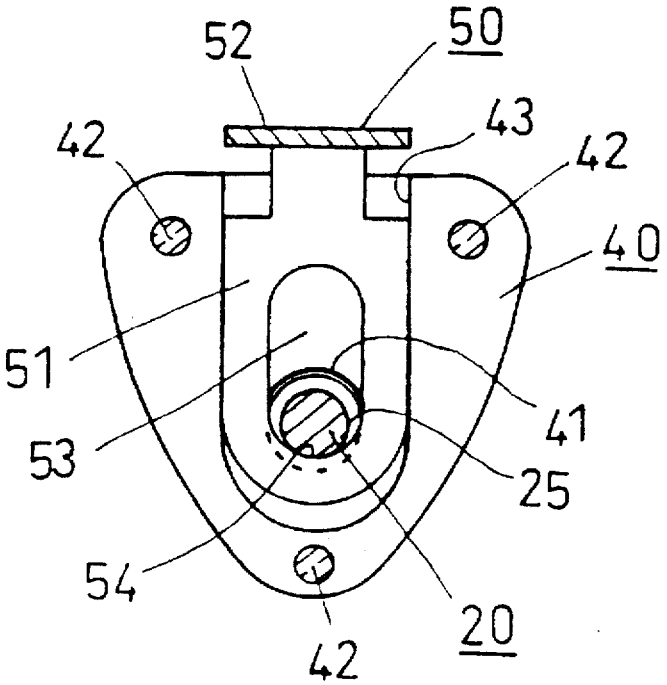
FIG. 5 is a cross section along line 5—5 of FIG. 4.

FIGS. 1 and 3 show a boom cymbal stand 10 comprising a main stand body 11 and a leg section 12. It includes an attachment and detachment mechanism for a weight on a boom rod. The mechanism is comprised of a boom rod 20 with an attachment part to be received in a weight 30, a cover 40 over the side of the weight, a boom rod attachment and detachment lever 50 and a spring 60 that acts on the cover 40.

Figure 2:
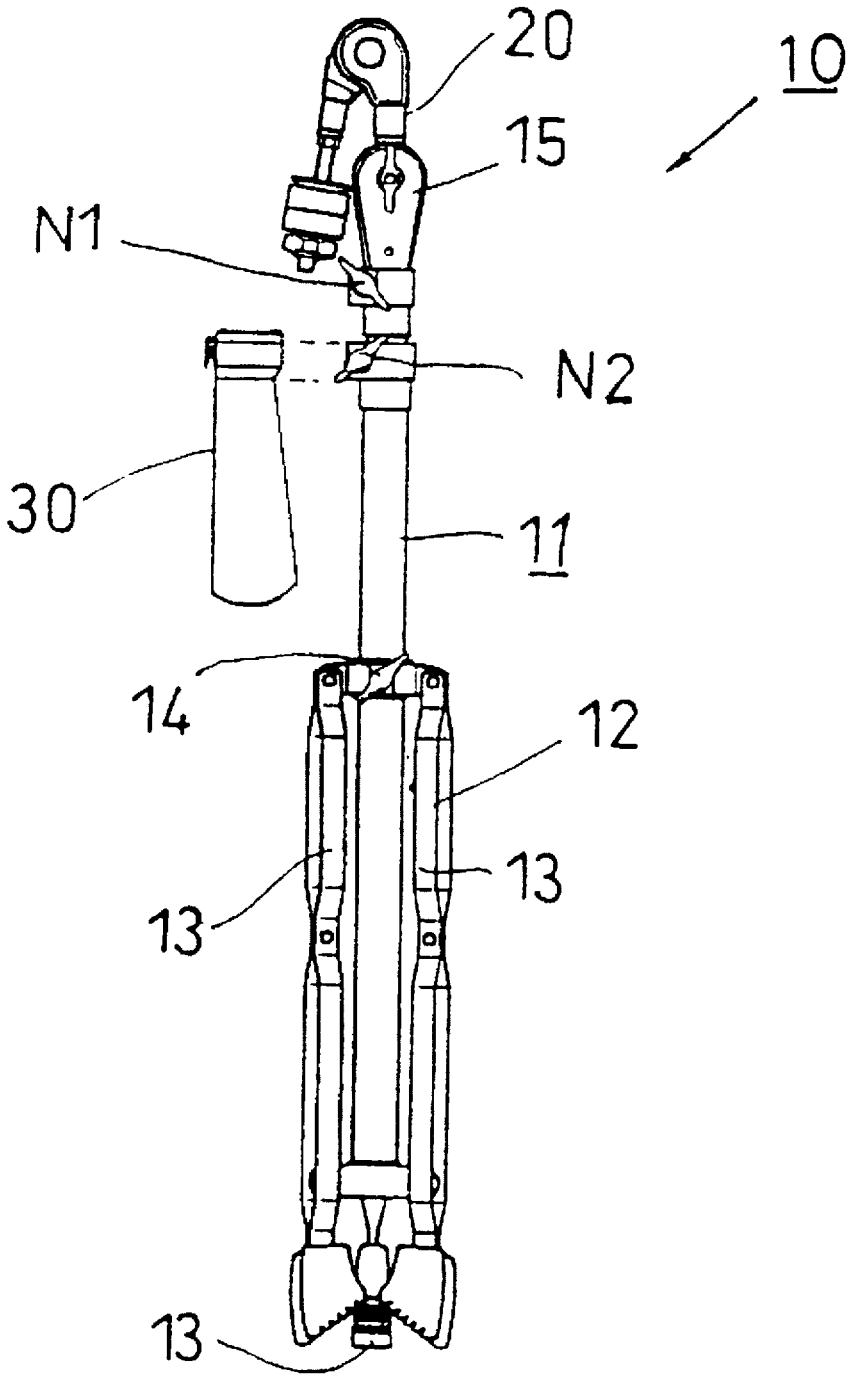
FIG. 2 is a front view showing the manner in which the stand is folded.

The weight 30 can be easily attached to or detached from the boom rod 20, as shown in FIGS. 1 and 2, thereby making it possible to assemble or disassemble the stand quickly and easily. Moreover, even if the boom rod 20 is extended to be longer, the stand 10 remains very stable. As a result, the drum set can be of a desired design, thereby giving a strong impression to the audience.

The main stand body 11 comprises a plurality of pipes P1, P2 and P3 disposed one above the other. The diameter of the pipe at the top may be smaller than that of the lower pipe, making it possible for the upper pipe to be received in the lower pipe. In addition, the positions of the pipes can be fixed by using pipe length adjusting screws N1 and N2, setting the height of the stand.

The leg section 12 comprises three main legs. Their tops are pivotally supported at the lower part of the main stand body 11 through annular installation body 14. The central part of the body 14 is also rotatably provided at the lower part of the main stand body 11. The annular installation body 14 is freely slidingly inserted onto the pipe P1. As the installation body 14 is moved along the pipe P1, the legs 13 radially open apart or close together with the main stand body 11 as the center, enabling the stand 10 to be erected or folded.

A rod installation part 15 is provided at the tip of the top pipe P3 of the main stand body 11. This part 15 enables adjustment of the position of the boom rod and is then operable to secure the boom rod 20. The installation part is comprised of a rod holder 16 and the boom rod 20 is inserted and is held there by a fixing screw N4. The boom rod 20 is inserted into the rod holder 16 at a desired location and the fixing screw N4 is tightened to secure the rod.

The boom rod 20 has a cymbal holder 21 at one end and has an installation part 22 for the installation of a weight 30 at the other end. A suitable convex-concave 28 is provided on the outer periphery at the center of the boom rod 20 to enable the boom rod 20 to be held without sliding at the rod holder 16.

The cymbal holder 21 comprises a cymbal installation part 23 and an angle adjusting part 24. The cymbal installation part 23 is comprised of a suitable bolt and a nut. As the bolt is inserted into the central hole of the cymbal S and this attachment tightened with a nut, the cymbal is secured.

In addition, the angle adjusting part 24 maintains the cymbal S at an angle selected by the performer. The angle adjusting part 24 is fixed at a prescribed angle to the boom rod 20 by a positioning screw N5.

As shown in FIG. 3, the installation part 22 toward the end of the boom rod 20 has an annular groove 25 formed in it. This groove 25 receives and engages the engagement part on edge 54 of a rod attaching and detaching lever 50.

The weight 30 balances the weight of the cymbal S that is held by the cymbal holder 21 and compensates for the length or incline of the boom rod 20 by giving a prescribed weight to the installation part end of the boom rod 20, thereby providing stability to the boom cymbal stand 10. The weight 30 has an insertion hole 31 at one side into which the installation part 22 of the boom rod 20 is inserted.

This insertion hole 31 receives the end part of the rod 20 that is past the annular groove 25. The depth of the hole 31 is such that, when the installation part 22 of the rod has been fully inserted, the annular groove part 25 may be exposed slightly from the opening 32 into the insertion hole 31.

A cover 40 is fixed over the side of the weight having in it the opening 32 into the insertion hole 31 of the weight 30. The cover 40 receives the front installation part 22 of the rod 20 at the side of the annular groove 25 toward the cymbal holder 21. The cover has a hole 41 through which the installation part 22 of the rod 20 is inserted and the hole 41 is at a position which is aligned with the insertion hole 31. The cover 40 comprises a plate body of such a periphery that it does not protrude from the periphery when the cover is installed on the weight 30 by installation screws 42.

The rod attaching and detaching lever 50 is held slidingly between the weight 30 and the cover 40. A cut 43 that opens to the top periphery of the cover is provided on that surface of the cover 40 that is toward the opening 32 to hold the change-over plate 51 of the lever 50.

The rod attaching and detaching lever 50 is for firmly and simply attaching and easily detaching the installation part 22 of the boom rod 20 to the weight 30. The lever 50 is comprised of a change-over plate 51 and a holder 52.

The change-over plate 51 has a window 53 through it and an engagement part 54 is defined at an edge of the window. The window 53 is a vertically elongated hole through which the installation part 22 of the boom rod 20 is inserted. The installation part can slide along the hole 53 in the part 51 as the cover is moved relative to the rod 20. The engagement part 54 engages and fixes the boom rod 20 and, through the cover 40 which is fastened on, engages the weight 30 so that the rod 20 will thereafter not shift relative to the weight 30. The engagement part 54 is defined at one side of the inner periphery of the window 53. In this change-over plate 51, at least the engagement part 54 is formed thinner in its thickness, as compared with the width of the annular groove 25 of the boom rod 20. As a consequence, the engagement part 54 securely engages in the annular groove 25.

The holder 52 is operable for sliding the change-over plate 51 and is integral with and is bent over at an end of the change-over plate 51. The holder is located at the opposite side of the plate 51 from the engagement part 54. The holder 52 protrudes out from above the cut 43 in the cover 40.

A spring 60 between the holder 52 and the weight 30 applies an outward force to the rod attaching and detaching lever 50. The spring 60 is a coil spring with one end inserted into a spring installation hole 33 on the surface of the weight 30. The other end of the spring 60 projects through the surface of the weight 30 and presses against the underside of the holder 52.

The spring 60 pushes up on the holder 52 from its underside to slide the holder to a position where the engagement part 54 of the change-over plate 51 may slightly protrude into the path through the hole 41 of the cover and the insertion hole 31.

When the holder 52 is pressed inward, i.e., toward the weight 30, the spring 60 is compressed and the engagement part 54 is pushed down along with the change-over plate 51 until the part 54 does not interfere with the path for the rod 20, 22 through the holes 31 and 41. As the holder 52 is held or released, the window 53 of the change-over plate 51 is slid in front of the hole 31 into the weight 30, thereby effectively engaging and releasing the engagement part 54 in the annular groove 25 of the installation part 22 of the boom rod 20.

When force is removed from the holder 52, the engagement part 54 at one side of the window 53 is returned by the elastic force of the spring 60 to engage in the groove 25 if the rod 20 is installed in the weight 30. It is apparent that the spring, holder and engagement part may be oriented so that release of the engagement part from the rod may be done by pulling on the holder, rather than by pushing on it.

The weight 30 is installed on the boom rod 20 in the following way. The holder 52 of the rod attaching and detaching lever 50 is pressed down toward the weight, thereby holding down the engagement part 54 and completely aligning the hole 41 in the cover 40, the insertion hole 31 in the weight 30 and the window 53 without the engagement part 54 protruding into that open pathway. With the parts in this state, the installation part 22 of the boom rod 20 is inserted into the insertion hole 31 of the weight 30 through the window 53 in the rod attaching and detaching lever 50 and the hole 41 in the cover 40.

A buffer 17 made of sponge, etc. is arranged beforehand at the bottom of the insertion hole 31. The tip of the boom rod 20 is inserted until it hits the bottom of the insertion hole 31. The operator's hand is released from the holder 52 of the lever 50. Thereupon, the said change-over plate 51 slides by the opening 32 under the force of the spring 60. This causes engagement part 54 to engage in the annular groove 25 of the boom rod 20.

The boom rod 20 is accurately held by the insertion hole 31 of the weight 30 and the hole 41 of the cover 40 at the engagement part 54 and also at the front and the back of the annular groove 25.

Figure 6:
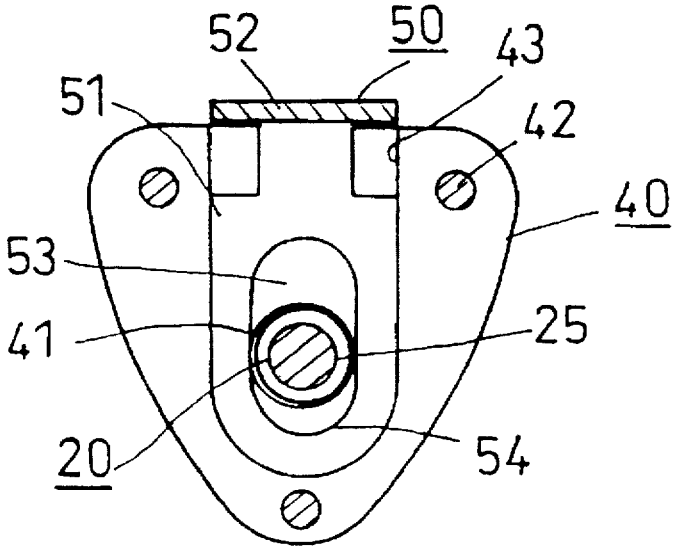
FIG. 6 is a cross section along the same line 6—6 indicating the condition in which the holder of the rod attachment and detachment lever has been pressed inward in FIG. 4.

To remove the weight 30 off the boom rod 20, the holder part 52 of the rod attaching and detaching lever 50 is again pressed toward the weight 30, as shown in FIG. 6. This releases the engagement between the engagement part 54 of the change-over plate 51 and the annular groove 25 of the boom rod 20, and the installation part 22 of the boom rod 20 is in the free interior of the window 53 of the rod attaching and detaching lever 50. In that state, the boom rod 20 can be easily pulled out of the insertion hole 31 of the weight 30.

According to the invention, a weight can be installed on the boom rod, such that the stability of the boom cymbal stand is extremely high, even if the boom rod may be extended long or if the incline of the rod may be changed. As a result, a satisfactory impression is achieved with an improved impact of the outside appearance of the drum set. In addition, since attachment or detachment between the weight and the boom rod can be effected easily and accurately, the operability of the stand increases. Further, the stand can be compactly folded effectively, thereby making it highly convenient for being carried.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A mechanism for attaching and detaching a weight to a boom cymbal stand, comprising a boom rod having a length, a cymbal holding part on the rod, a weight receiving installation part toward the end of the rod away from the cymbal holding part;

a support stand attachable to the boom rod along its length;

a weight having a side with an insertion hole in it, the installation part of the boom rod being received in the insertion hole;

a cover over the side of the weight, the cover having a hole through it aligned with the insertion hole in the weight enabling the installation part of the rod to pass through the hole in the cover into the insertion hole;

a boom rod installation and detachment lever including a change-over plate disposed between the cover and the side of the weight and being supported for movement between the cover and the weight in a path across the insertion hole, the change-over plate having a window through it which is alignable with the hole in the cover and the insertion hole enabling the installation part of the boom rod to pass through the window into the insertion hole;

the change-over plate including a rod engagement part which is movable into engagement with the rod installation part such engagement being for holding the weight securely to the cover and thereby to the rod;

a spring normally urging the lever to move the change-over plate for causing engagement between the engagement part and the installation part, the change-over plate being movable against the urging of the spring for releasing engagement of the engagement part and the boom rod, enabling either insertion of the boom rod into or removal of the boom rod from the hole in the weight, through the window of the change-over part and through the hole in the cover.

2. The mechanism of claim 1, wherein a groove is located on the installation part of the rod to be outside the hole when the installation part is installed in the hole in the weight and placed such that movement of the change-over plate moves the engagement part into engagement in the groove of the installation part.

3. The mechanism of claim 2, wherein the groove is annular around the installation part.

4. The mechanism of claim 1, wherein the rod installation and detaching lever includes a holder formed with the change-over plate, the spring extending between the holder of the lever and the weight, and the spring normally urging the holder to move the change-over part of the lever to bring the engagement part into engagement with the boom rod.

5. The mechanism of claim 1 wherein the change-over plate is supported to slide between the rod engaging and disengaging position.

6. The mechanism of claim 4, wherein the window through the change-over plate of the lever has a periphery, the engagement part of the change-over plate is on the periphery of the window, whereby upon shifting of the change-over part under the urging of the spring, the boom rod moves through the window until it engages the installation part.

7. The mechanism of claim 6, wherein a groove is located on the installation part of the rod to be outside the hole when the installation part is installed in the hole in the weight and placed such that movement of the change-over plate moves the engagement part into engagement in the groove of the installation part.

8. The mechanism of claim 6, wherein the holder of the lever is toward one side of the change-over plate of the lever with reference to the boom rod and the engagement part of the plate is to the opposite side of the boom rod, such that pressure applied to the holder to counteract the force of the spring moves the engagement part out of engagement with the boom rod.

9. The mechanism of claim 1, wherein the stand connected to the boom rod includes an adjustable connection between the stand and the boom rod for selectively allowing the tilt angle of the boom rod with respect to stand, or the length of the boom rod with reference to the stand, or the position of the boom rod on the stand to be adjusted.

10. A mechanism for attaching and detaching a weight to a boom cymbal stand, comprising a boom rod having a length, a cymbal holding part toward one end of the rod, a weight receiving installation part toward the other end of the rod, an annular groove around the rod at the installation part; a stand attachable to the boom rod along its length;

a weight having a side with an insertion hole in it, the installation part of the boom rod being received in the hole in the weight, with the groove in the installation part of the boom rod on the outside the hole when the installation part is installed in the hole in the weight;

a cover over the side of the weight, the cover having a hole through it aligned with the insertion hole in the weight enabling the installation part of the rod to pass through the hole in the cover into the insertion hole in the weight;

a boom rod installation and detachment lever including a change-over plate disposed between the cover and the side of the weight and being supported for sliding movement between the cover and the weight in a path across the insertion hole, the change-over plate having a window through it which is alignable with the hole in the cover and the insertion hole enabling the installation part of the boom rod to pass through the window into the insertion hole;

the change-over plate including a rod engagement part which is movable into engagement with the annular groove of the boom rod such engagement being for holding the weight securely to the cover and thereby to the rod;

a spring normally urging the lever to move the change-over plate for causing engagement between the engagement part and the annular groove of the boom rod, the change-over plate being movable against the urging of the spring for releasing engagement of the engagement part and the annular groove of the boom rod, enabling either insertion of the boom rod into and removal of the boom rod from the hole in the weight, through the window of the change-over part and through the hole in the cover.

* * * * *